US011479435B2

(12) United States Patent
Takahashi

(10) Patent No.: US 11,479,435 B2
(45) Date of Patent: Oct. 25, 2022

(54) MEDIUM EJECTION APPARATUS

(71) Applicant: RISO KAGAKU CORPORATION, Tokyo (JP)

(72) Inventor: Hisayuki Takahashi, Tsukuba (JP)

(73) Assignee: RISO KAGAKU CORPORATION, Tokyo (JP)

( * ) Notice: Subject to any disclaimer, the term of this patent is extended or adjusted under 35 U.S.C. 154(b) by 66 days.

(21) Appl. No.: 17/143,389

(22) Filed: Jan. 7, 2021

(65) Prior Publication Data

US 2021/0237999 A1 Aug. 5, 2021

(30) Foreign Application Priority Data

Jan. 30, 2020 (JP) ..... JP2020-013684
Jan. 30, 2020 (JP) ..... JP2020-013685

(51) Int. Cl.
*B65H 31/38* (2006.01)
*B65H 31/10* (2006.01)
*B65H 7/02* (2006.01)

(52) U.S. Cl.
CPC ..... *B65H 31/38* (2013.01); *B65H 7/02* (2013.01); *B65H 31/10* (2013.01); *B65H 2301/4222* (2013.01); *B65H 2801/06* (2013.01)

(58) Field of Classification Search
CPC ..... B65H 7/02; B65H 31/10; B65H 31/38; B65H 2301/4222
USPC ..... 270/58.12, 58.17, 58.27
See application file for complete search history.

(56) References Cited

U.S. PATENT DOCUMENTS 6,168,154 B1 * 1/2001 Asahara ..... B65H 31/3081 414/788.9
6,889,974 B2 * 5/2005 Tamura ..... B65H 29/14 271/220
7,014,183 B2 * 3/2006 Tamura ..... B65H 33/08 271/220
7,021,617 B2 * 4/2006 Herrmann ..... B65H 33/08 270/58.11
8,070,150 B2 * 12/2011 Tanaka ..... B65H 31/10 270/58.11

(Continued)

FOREIGN PATENT DOCUMENTS

JP 2011-256047 12/2011
JP 2014043333 A * 3/2014 ..... B65H 29/70

*Primary Examiner* — Leslie A Nicholson, III
(74) *Attorney, Agent, or Firm* — Greenblum & Bernstein, P.L.C.

(57) ABSTRACT

A medium ejection apparatus including: a placement mount on which media are placed; a medium-leading-edge position restriction part that moves between a restriction position at which the restriction part restricts a position of a leading edge portion of a medium ejected toward the placement mount with reference to an ejection direction of the medium and a retracted position retracted from the restriction position; and a medium position control unit that controls the medium-leading-edge position restriction part such that the medium-leading-edge position restriction part performs a leading-edge restriction operation of moving from the retracted position to the restriction position and moving from the restriction position to the retracted position when the medium-leading-edge position restriction part and an upper surface of a medium are not in contact with each other.

13 Claims, 15 Drawing Sheets

(56) References Cited

U.S. PATENT DOCUMENTS

| | | | | |
|---|---|---|---|---|
| 8,177,227 | B2 * | 5/2012 | Uchiyama | B65H 31/10<br>271/226 |
| 8,251,362 | B2 * | 8/2012 | Konishi | B65H 31/34<br>270/58.27 |
| 8,387,974 | B2 * | 3/2013 | Hayashi | B65H 33/08<br>271/220 |
| 8,752,819 | B2 * | 6/2014 | Sato | B65H 31/26<br>270/58.12 |
| 8,967,616 | B2 * | 3/2015 | Sugitani | B65H 33/08<br>271/223 |

* cited by examiner

MEDIUM EJECTION APPARATUS

CROSS-REFERENCE TO RELATED APPLICATION

This application is based upon and claims the benefit of priority of the prior Japanese Patent Application No. 2020-13684 and No. 2020-13685, both filed on Jan. 30, 2020, the entire contents of which are incorporated herein by reference.

FIELD

The aspects described herein are related to a medium ejection apparatus in which media are placed.

BACKGROUND

A conventionally known medium ejection apparatus in which media such as sheets are placed includes a restriction part such as an end fence that moves between a restriction position at which the restriction part restricts media ejected toward a placement mount (placement position) and a retracted position retracted from the restriction position. The restriction part of such a medium ejection apparatus performs a restriction operation (jogger operation) wherein when media are ejected toward the placement mount, the restriction part moves from the retracted position to the restriction position and moves from the restriction position to the retracted position.

Meanwhile, a proposed sheet processing apparatus includes a pair of joggers for pushing sheets ejected on a sheet mount toward an offset position and a pair of sheet fences for restricting the sheets pushed by the joggers at the offset position (e.g., Japanese Laid-open Patent Publication No. 2011-256047).

SUMMARY

In an aspect, a medium ejection apparatus includes: a placement mount on which media are placed; a medium-leading-edge position restriction part that moves between a restriction position at which the medium-leading-edge position restriction part restricts a position of a leading edge portion of a medium ejected toward the placement mount with reference to an ejection direction of the medium and a retracted position retracted from the restriction position; and a medium position control unit that controls the medium-leading-edge position restriction part in such that the medium-leading-edge position restriction part performs a leading-edge restriction operation of moving from the retracted position to the restriction position and moving from the restriction position to the retracted position when the medium-leading-edge position restriction part and an upper surface of the medium are not in contact with each other, and controls the medium-leading-edge position restriction part such that the medium-leading-edge position restriction part does not perform the leading-edge restriction operation when the medium-leading-edge position restriction part and the upper surface of the medium are in contact with each other.

The object and advantages of the present invention will be realized by the elements recited in the claims or combinations thereof.

DESCRIPTION OF EMBODIMENTS

Figure 14:
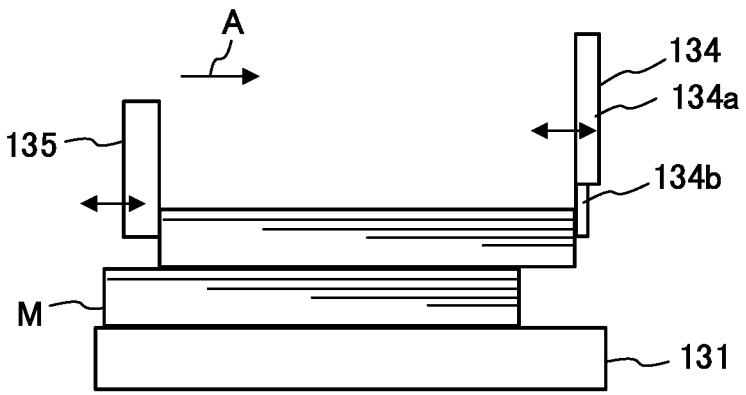
FIG. 14 is a front view illustrating an end fence and an offset guide in a reference art.

FIG. 14 is a front view illustrating an end fence 134 and an offset guide 135 in a reference art.

Figure 15:
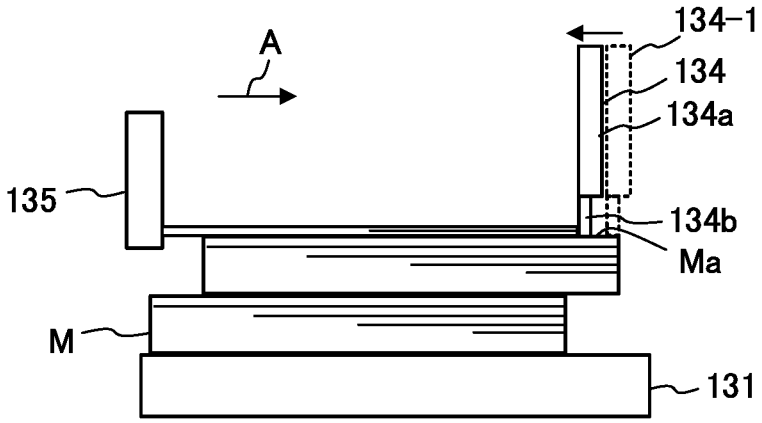
FIG. 15 is a front view for illustrating a restriction operation performed by an end fence in a reference art.

FIG. 15 is a front view for illustrating a leading-edge restriction operation (restriction operation) performed by an end fence 134 in a reference art.

The end fence 134 depicted in FIG. 14 restricts the position of the leading edge portions of media M ejected toward a placement mount 131 with reference to an ejection direction A. The end fence 134 includes a fence body 134*a* and an abutment member 134*b* protruding downward from the fence body 134*a*.

The offset guide 135 is disposed to face the end fence 134 across media M.

The end fence 134 and the offset guide 135 are disposed to be capable of moving forward or rearward in the ejection direction A of media M (left-right direction in FIG. 14) and perform an offset operation for offsetting the placement position of media M placed on the placement mount 131 forward or rearward in the ejection direction A of media M.

As depicted in FIG. 15, the end fence 134 can move between a restriction position (represented by solid lines) at which the end fence 134 restricts the position of the leading edge portions of media M ejected toward the placement mount 131 with reference to the ejection direction A and a retracted position (end fence 134-1) (represented by dashed lines) retracted from the restriction position. When a medium M is ejected toward the placement mount 131, the end fence 134 performs the leading-edge restriction operation (restriction operation) in which the end fence 134 moves from the retracted position to the restriction position and moves from the restriction position to the retracted position.

However, when media M are placed at a rear position in the ejection direction A (left side in FIG. 15) as a result of the end fence 134 and the offset guide 135 performing the offset operation as described above, placed media M are positioned under the end fence 134. If the end fence 134 (abutment member 134*b*) contacts the upper surface Ma of a medium M located thereunder while moving between the retracted position and the restriction position, the medium M could be displaced, or the medium M and the end fence 134 could scrap against each other and thus cause an image deficiency in an image printed on the upper surface Ma of the medium M.

Similarly, a sheet processing apparatus that includes a pair of joggers and a pair of sheet fences as described above could have displacement of a medium or an image deficiency if the joggers and the upper surface of the medium contact while the joggers are moving between the restriction position and the retracted position.

The following describes a medium ejection apparatus in accordance with embodiments of the present invention by referring to the drawings.

An Embodiment

Figure 1:
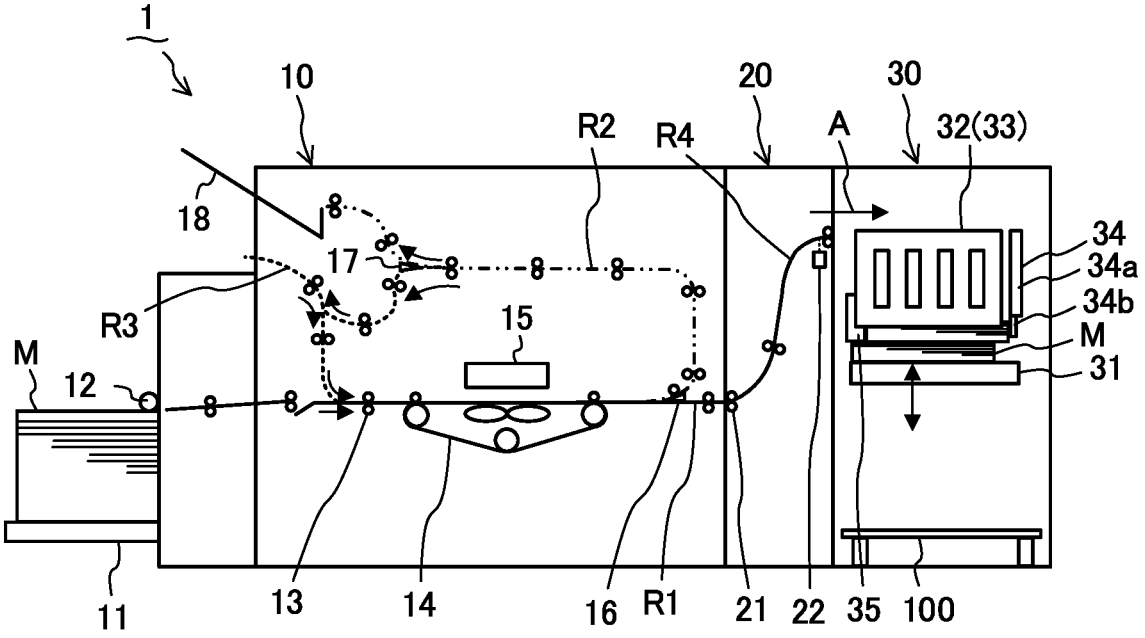
FIG. 1 illustrates the internal configuration of a printing system that includes a medium ejection apparatus in accordance with an embodiment.

FIG. 1 illustrates the internal configuration of a printing system 1 that includes a medium ejection apparatus 30 in accordance with an embodiment.

Figure 2:
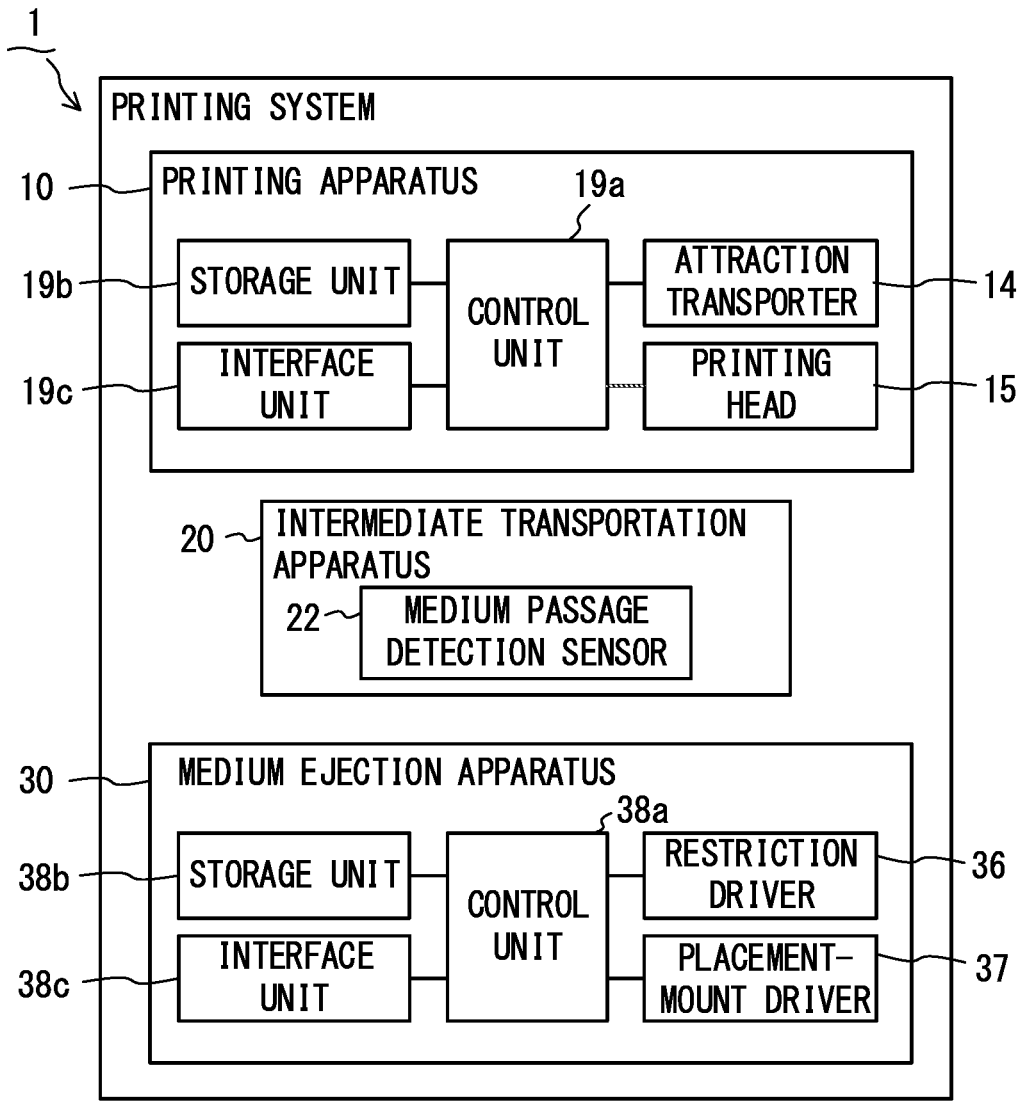
FIG. 2 illustrates main control components of a printing system that includes a medium ejection apparatus in accordance with an embodiment.

FIG. 2 illustrates main control components of the printing system 1.

The printing system 1 depicted in FIGS. 1 and 2 includes a printing apparatus 10, an intermediate transportation apparatus 20, and a medium ejection apparatus 30.

In FIG. 1, solid lines indicate a straight transportation path R1 for media M within the printing apparatus 10 and an ejection path R4 for the media M within the intermediate transportation apparatus 20. In addition, FIG. 1 uses a two-dot dash line to indicate a circulation transportation path R2 for the media M within the printing apparatus 10 and uses a dashed line to indicate an inversion transportation path R3 within the printing apparatus 10. As an example, the media M may be sheet-like media, e.g., flat paper (sheets).

As depicted in FIG. 1, the printing apparatus 10 includes a medium supply part 11, a drawing-out roller 12, a plurality of transportation roller pairs 13, an attraction transporter 14, a printing head 15, transportation-path switching parts 16 and 17, and a placement mount 18. As depicted in FIG. 2, the printing apparatus 10 also includes a control unit 19*a*, a storage unit 19*b*, and an interface unit 19*c*. The printing system 1 includes the single printing apparatus 10 but may include, for example, a plurality of printing apparatuses arranged in series with transportation paths for media M.

Media M are placed on the medium supply part 11. The medium supply part 11 is disposed integrally with the printing apparatus 10 but may be separate from the printing apparatus 10.

The drawing-out roller 12 draws out and transports an uppermost medium M of the plurality of media M placed on the medium supply part 11.

A plurality of transportation roller pairs 13 are provided for each of the straight transportation path R1, the circulation transportation path R2, and the inversion transportation path R3 within the printing apparatus 10 and transport a medium M in a nipping manner.

The attraction transporter 14 faces the printing head 15. The attraction transporter 14 transports a medium M by means of, for example, a belt while attracting the medium M.

The drawing-out roller 12, the plurality of transportation roller pairs 13, the attraction transporter 14, and a plurality of transportation roller pairs 21 in the intermediate transportation apparatus 20 (described hereinafter) are examples of transporters for transporting media M.

For example, the printing head 15 may include line-head-type inkjet heads (not illustrated) for various colors to be used in printing. The printing head 15 may use a printing scheme other than the inkjet printing scheme. Thus, the printing head 15 is merely an example of a printing unit that prints on a medium M, and this printing unit is not limited to the printing head 15 using the inkjet printing scheme.

The transportation-path switching part 16 switches the transportation path for a medium M that has undergone printing by the printing head 15 between the straight transportation path R1 leading to the intermediate transportation apparatus 20 and the circulation transportation path R2 leading to the placement mount 18 or the inversion transportation path R3.

The transportation-path switching part 17 switches the circulation transportation path R2 for a medium M between a transportation path leading to the placement mount 18 and a transportation path leading to the inversion transportation path R3. The front and back sides of the medium M are inverted on the inversion transportation path R3, and then the medium M is transported again to the printing head 15.

Media M not to be ejected to the medium ejection apparatus 30 are placed on the placement mount 18.

The control unit 19*a* depicted in FIG. 2 includes a processor (e.g., central processing unit (CPU)) that functions as an arithmetic processing apparatus for controlling the operations of the entirety of the printing apparatus 10 and controls the operations of components such as the drawing-out roller 12, the plurality of transportation roller pairs 13, the attraction transporter 14, and the printing head 15. The control unit 19*a* also controls the plurality of transportation roller pairs 21 of the intermediate transportation apparatus 20 (described hereinafter). The printing system 1 may have disposed therein a control unit that serves as both the control unit 19*a* of the printing apparatus 10 and a control unit 38*a* for the medium ejection apparatus 30 (described hereinafter).

For example, the storage unit 19*b* may be a read only memory (ROM) that is a read-only semiconductor memory having a predetermined control program recorded therein in advance, or a random access memory (RAM) that is a randomly writable/readable semiconductor memory used as a working storage region on an as-needed basis when a processor executes various control programs.

The interface unit 19*c* communicates various information with devices such as the medium ejection apparatus 30. For example, on the basis of a print job, a detection result provided by a sensor (not illustrated) disposed on the medium supply part 11, settings of the printing apparatus 10, and the like, the interface unit 19*c* may send ejection medium information of a medium M such as the size, the orientation, the type (e.g., thickness, grammage, material), or the transportation velocity (i.e., the ejection velocity of the medium ejection apparatus 30) to the medium ejection apparatus 30.

The intermediate transportation apparatus 20 depicted in FIG. 1 includes a plurality of transportation roller pairs 21 and a medium passage detection sensor 22.

The plurality of transportation roller pairs 21 transport, in a nipping manner, a medium M ejected from the printing apparatus 10.

The medium passage detection sensor 22 detects the presence/absence of a medium M on the ejection path R4.

As depicted in FIG. 1, the medium ejection apparatus 30 includes a placement mount 31, side fences 32 and 33, an end fence 34, and an offset guide 35. As depicted in FIG. 2, the medium ejection apparatus 30 also includes a restriction driver 36, a placement-mount driver 37, a control unit 38*a*, a storage unit 38*b*, and an interface unit 38*c*.

The medium ejection apparatus 30 is separate from the printing apparatus 10 but may be disposed integrally with the printing apparatus 10. The medium ejection apparatus 30 may also have placed therewithin media M ejected from a processing apparatus for performing non-printing processing on the media M or from a transportation apparatus for transporting media M, rather than media M that have undergone printing by the printing apparatus 10. When the intermediate transportation apparatus 20 is omitted, media M may be ejected from the printing apparatus 10 directly into the medium ejection apparatus 30.

Media M ejected from the intermediate transportation apparatus 20, i.e., media M ejected from the printing apparatus 10 and transported by the intermediate transportation apparatus 20, are placed on the placement mount 31. The placement mount 31 can be lifted or lowered by a driving operation performed by the placement-mount driver 37 (described hereinafter). The placement mount 31 may be a belt conveyor or a roller conveyor on which media M are to be placed, i.e., a placement mount provided with a transportation means. The placement mount 31 is disposed in a removable manner within the medium ejection apparatus 30. When taking out media M, the placement mount 31 may be lowered onto a carriage 100 and taken out of the medium ejection apparatus 30 together with the media M. The placement mount 31 can be lifted or lowered but may be arranged to be incapable of being lifted or lowered.

Figure 3:
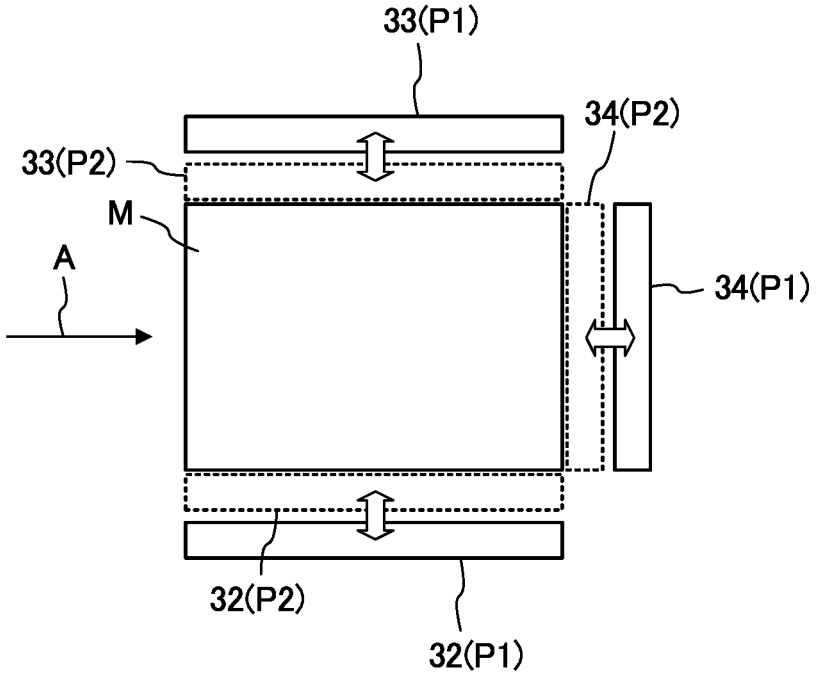
FIG. 3 is a plan view for illustrating a leading-edge restriction operation performed by an end fence and a width restriction operation performed by side fences in an embodiment.

As depicted in FIG. 3, the side fences 32 and 33 are disposed to face each other in the width direction of a medium M that is orthogonal to an ejection direction A in which the medium M is ejected toward the placement mount 31. The end fence 34 is located downstream in the ejection direction A (right side in FIG. 3) from the media M placed on the placement mount 31.

Figure 4:
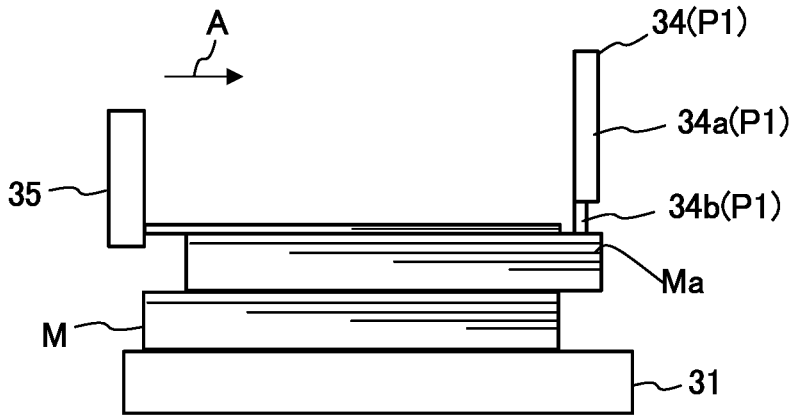
FIG. 4 is a front view illustrating an end fence and an offset guide in an embodiment.

As depicted in FIG. 4, the end fence 34 includes a fence body 34*a* and an abutment member 34*b* protruding downward from the fence body 34*a* and capable of moving up or down, wherein a medium M abuts the abutment member 34*b*.

For example, the abutment member 34*b* can be lifted by a driving operation performed by the restriction deriver 36 (described hereinafter) and can be lowered under the weight of the abutment member 34*b*. As an example, when a medium M is located under the end fence 34, after the placement position of the medium M is offset, the abutment member 34*b* may be in contact with the upper surface Ma of the medium M while being lowered under the weight thereof until the placement mount 31 is lowered a plurality of times. Afterward, when the placement mount 31 is still lowered, the abutment member 34*b* is maximally lowered under the weight thereof and then no longer in contact with the upper surface Ma of the medium M. Note that the length of the abutment member 34*b* in the width direction of the medium M that is orthogonal to the ejection direction A of the medium M is less than that of the fence body 34*a*. For example, two abutment members 34*b* spaced apart from each other in the width direction of the medium M may be provided.

As depicted in FIG. 3, the end fence 34 is an example of a medium-leading-edge position restriction part that moves between a restriction position P2 (represented by dashed lines in FIG. 3) at which the end fence 34 restricts the position of the leading edge portion of a medium M ejected toward the placement mount 31 with reference to the ejection direction A and a retracted position P1 retracted from the restriction position P2. The side fences 32 and 33 are examples of medium-width position restriction parts that move between restriction positions P2 (represented by dashed lines in FIG. 3) at which the restriction parts restrict the positions of the edge portions of a medium M ejected toward the placement mount 31 with reference to the width direction and retracted positions P1 retracted from the restriction positions P2. Note that the end fence 34 (medium-leading-edge position restriction part) may be the only component that moves between a retracted position P1 and a restriction position P2 like this. The medium-leading-edge position restriction part and the medium-width position restriction parts may be separate from the end fence and the side fences. The medium-leading-edge position restriction part and the medium-width position restriction parts are not limited to fences and may be members having any shape such as a plate-like shape, a wall-like shape, or a block-like shape.

The side fences 32 and 33 and the end fence 34 perform restriction operations (jogger operation) wherein these fences move from the retracted positions P1 to the restriction positions P2 and then, without stopping at, for example, the restriction positions P2, move from the restriction positions P2 to the retracted positions P1. Thus, the restriction operations may be considered to be shuttle operations of moving from the retracted positions P1 to the restriction positions P2 and returning to the retracted positions P1. For example, the restriction operations may be performed every time one or more media M are ejected toward the placement mount 31. The restriction operation performed by the side fences 32 and 33 may hereinafter be referred to as a width restriction operation, and the restriction operation performed by the end fence 34 may hereinafter be referred to as a leading-edge restriction operation. Unlike the placement mount 31, the side fences 32 and 33 and the end fence 34 cannot be lifted or lowered. However, these fences may be arranged to be capable of being lifted or lowered.

The offset guide 35 depicted in FIG. 4 is located upstream in the ejection direction A (left side in FIG. 4) from the media M placed on the placement mount 31.

The end fence 34 and the offset guide 35 are disposed to face the ejection direction A of media M ejected toward the placement mount 31. By being driven by the restriction driver 36 depicted in FIG. 2, the end fence 34 and the offset guide 35 can, for, for example, each print job, move forward or rearward in the ejection direction A (left-right direction in FIG. 4) so as to perform the offset operation for offsetting the placement position of media M forward or rearward in the ejection direction A. In this way, the end fence 34 and the offset guide 35 function as examples of offset means for performing the offset operation for offsetting the placement position of media M on the placement mount 31 forward or rearward in the ejection direction A. When the end fence 34 and the offset guide 35 move forward or rearward in the ejection direction A, the restriction driver 36 can lift and hold the abutment member 34*b* so as to prevent the abutment member 34*b* and the upper surface Ma of a medium M from being brought into contact with each other. In a case where the offset guide 35 is also provided with an abutment member protruding downward, when the end fence 34 and the offset guide 35 move forward or rearward in the ejection direction A, the abutment member of the offset guide 35 can also be lifted and held together with the abutment member 34*b* so as to be prevented from coming into contact with the upper surface Ma of a medium M.

The restriction driver 36 depicted in FIG. 2 includes one or more actuators such as motors that drive the end fence 34 and the offset guide 35 so as to perform the offset operation and drive the side fences 32 and 33 and the end fence 34 so as to perform the width restriction operation and the leading-edge restriction operation for media M in the process of being ejected. The restriction driver 36 may also include an actuator such as a motor that lifts, as described above, the abutment member 34*b* of the end fence 34.

For example, the placement-mount driver 37 may be an actuator such as a motor. The placement-mount driver 37 lifts or lowers the placement mount 31 under the drive control performed by the control unit 38*a*. The medium ejection apparatus 30 has disposed therein a placement-surface detection sensor (not illustrated) for detecting that the height of the placement surface of media M on the placement mount 31 has reached a predetermined height. On the basis of the detection result provided by the placement-surface detection sensor, the control unit 38*a* (described hereinafter) may control the placement-mount driver 37 so as to lower the placement mount 31 by, for example, a height corresponding to a predetermined number of sheets.

Figure 5A:
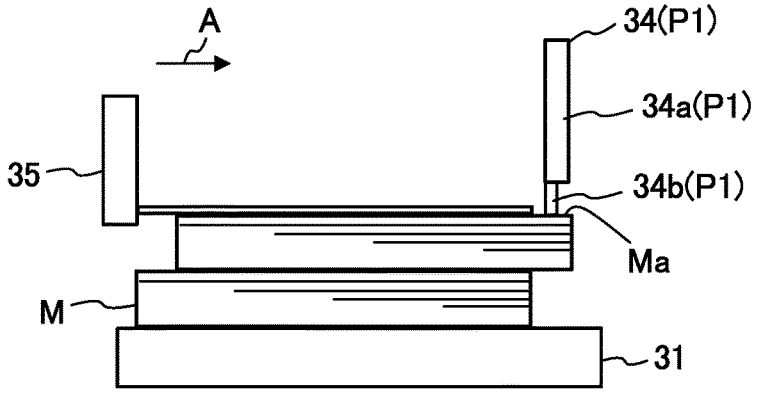
FIG. 5A is a front view for illustrating the skipping of a leading-edge restriction operation to be performed by an end fence in an embodiment (example 1)
Figure 5B:
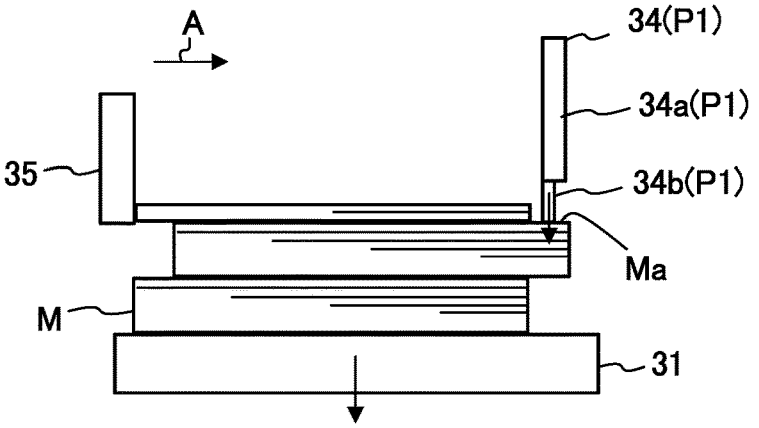
FIG. 5B is a front view for illustrating the skipping of a leading-edge restriction operation to be performed by an end fence in an embodiment (example 2)
Figure 10A:
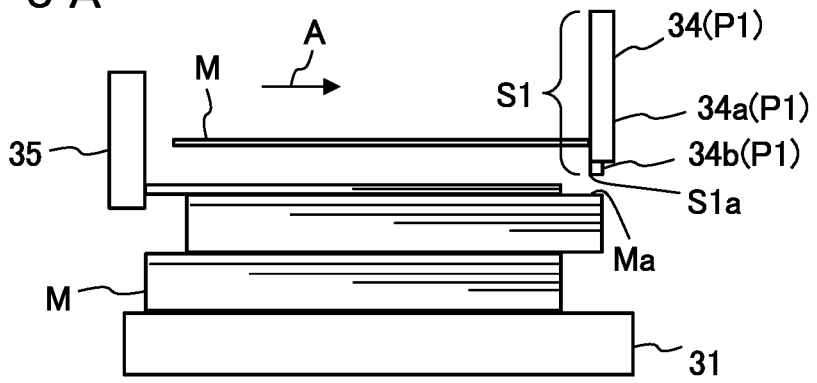
FIG. 10A is a front view for illustrating a restriction operation performed by an end fence in another embodiment (example 1)
Figure 10B:
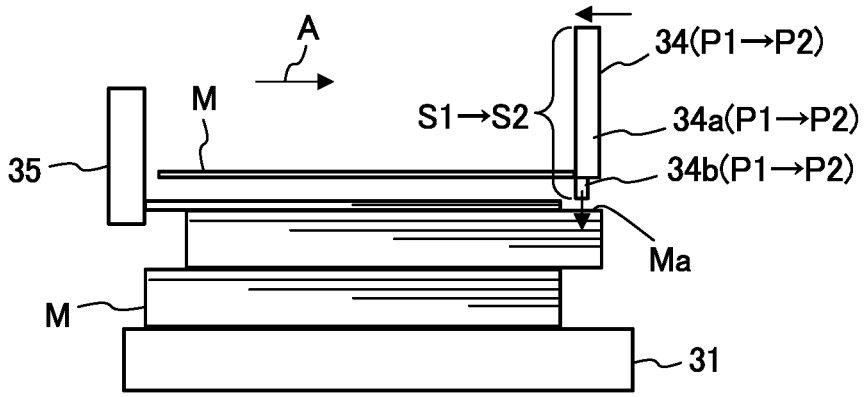
FIG. 10B is a front view for illustrating a restriction operation performed by an end fence in another embodiment (example 2)
Figure 10C:
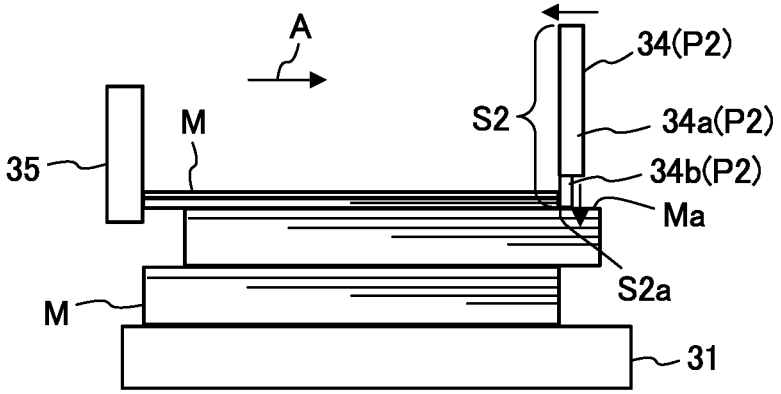
FIG. 10C is a front view for illustrating a restriction operation performed by an end fence in another embodiment (example 3)

The control unit 38*a*, which is an example of a medium position control unit, includes a processor (e.g., CPU) that functions as an arithmetic processing apparatus for controlling the operations of the entirety of the medium ejection apparatus 30 so as to control components such as the restriction driver 36 and the placement-mount driver 37. As will be described hereinafter in detail, when the abutment member 34*b* of the end fence 34 and the upper surface Ma of a medium M are in contact with each other as depicted in FIGS. 5A and 5B, the control unit 38*a* skips the leading-edge restriction operation to be performed by the end fence 34. In addition, as will be described hereinafter by referring to another embodiment, the control unit 38*a* controls the end fence 34 by using the restriction driver 36 such that, as depicted in FIGS. 10A-10C, when the end fence 34 is located at the retracted position P1 (lower edge portion S1*a* of abutment surface S1), the lower edge portion S1*a*, S2*a* of the abutment surface S1, S2, which is abutted by media M, is positioned higher than when the end fence 34 is located at the restriction position P2 (lower edge portion S2*a* of abutment surface S2), and when the end fence 34 is located at a position other than the restriction position P2, the end fence 34 is not in contact with the upper surface Ma of a medium M placed on the placement mount 31.

For example, the storage unit 38*b* may be a ROM that is a read-only semiconductor memory having a predetermined control program recorded therein in advance, or a RAM that is a randomly writable/readable semiconductor memory used as a working storage region on an as-needed basis when a processor executes various control programs.

The interface unit 38*c* communicates various information with devices such as the printing apparatus 10 and the intermediate transportation apparatus 20. For example, the interface unit 38*c* may acquire the ejection medium information described above from the printing apparatus 10 and acquire a detection result provided by the medium passage detection sensor 22. The control unit 38*a* controls the restriction driver 36 such that the side fences 32 and 33 and the end fence 34 perform the width restriction operation and the leading-edge restriction operation when a predetermined time period has elapsed after a medium M passed the medium passage detection sensor 22.

The following describes in more detail the leading-edge restriction operation performed by the end fence 34.

FIG. 4 is a front view illustrating the end fence 34 and the offset guide 35.

FIGS. 5A-5D are front views for illustrating the skipping of the leading-edge restriction operation to be performed by the end fence 34.

As described above, the end fence 34, together with the side fences 32 and 33, performs the leading-edge restriction operation wherein, as depicted in FIG. 3, the end fence 34 moves from the retracted position P1 to the restriction position P2 and then, without stopping at, for example, the restriction position P2, moves from the restriction position P2 to the retracted position P1. However, media M could be placed under the end fence 34 as a result of the end fence 34 and the offset guide 35 performing the offset operation toward the opposite side, i.e., rearward in the ejection direction A. In this case, when the number of placed media M after the offset operation is small, the abutment member 34*b*, which is lowered under the weight thereof, will come into contact with the upper surface Ma of a medium M. If the end fence 34 performs the leading-edge restriction operation when the abutment member 34*b* and the upper surface Ma of a medium M are in contact with each other like this, while the end fence 34 is moving between the retracted position P1 and the restriction position P2, the medium M could be displaced, or the upper surface Ma of the medium M and the end fence 134 could scrap against each other and thus cause an image deficiency in an image printed on the upper surface Ma of the medium M.

Accordingly, the control unit 38*a* depicted in FIG. 2 skips the leading-edge restriction operation to be performed by the end fence 34 in a case where the abutment member 34*b* of the end fence 34 and the upper surface Ma of a medium M are, as depicted in FIGS. 5A and 5B, in contact with each other when a predetermined number of media M have been ejected for the first time after the offset operation was performed rearward in the ejection direction A.

Directly after the placement position of media M is offset leftward in FIG. 5A (rearward in the ejection direction A) as a result of the offset operation being performed by the end fence 34 and the offset guide 35, the abutment member 34*b* is, as depicted in FIG. 5A, in contact with a medium M under the end fence 34 and thus has not been maximally lowered under the weight thereof.

Afterward, the abutment member 34*b* is, as depicted in FIG. 5B, in contact with the upper surface Ma of a medium M while being lowered under the weight thereof until the placement mount 31 is lowered a plurality of times after the offset operation was performed.

Figure 5C:
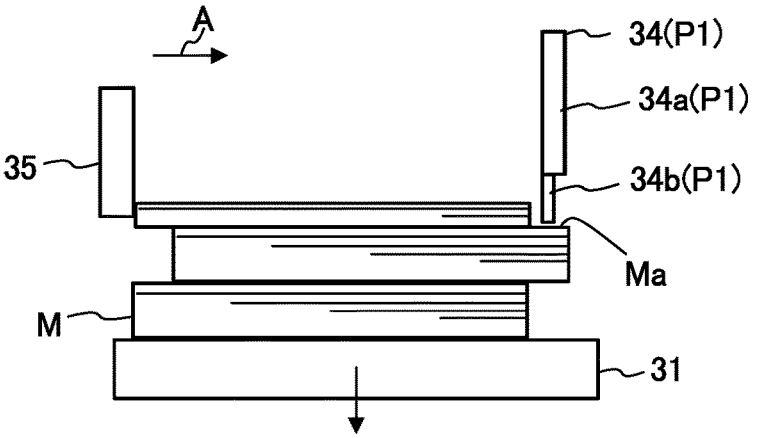
FIG. 5C is a front view for illustrating the skipping of a leading-edge restriction operation to be performed by an end fence in an embodiment (example 3)

When the placement mount 31 is still lowered, the abutment member 34*b* is maximally lowered under the weight thereof and then no longer in contact with the upper surface Ma of the medium M, as depicted in FIG. 5C. When the abutment member 34*b* has come to be no longer in contact with the upper surface Ma of the medium M, the end fence 34 performs, as depicted in FIG. 3, the leading-edge restriction operation of moving from the retracted position P1 to the restriction position P2 and moving from the restriction position P2 to the retracted position P1. It can be determined whether the end fence 34 (abutment member 34*b*) and the upper surface Ma of a medium M are in contact with each other by using a sensor for emitting detection light to the position of contact, but the control unit 38*a* can make such a determination on the basis of the amount of lowering of the placement mount 31 after the offsetting of the placement position of media M or the maximum amount of lowering of the abutment member 34*b* after the offsetting.

Figure 5D:
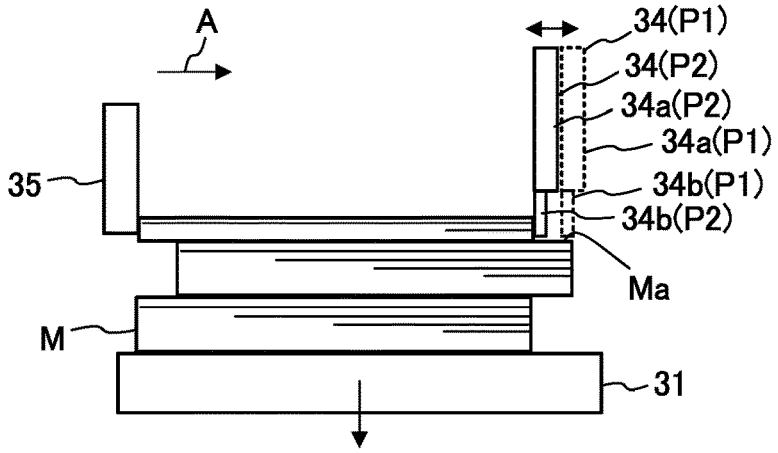
FIG. 5D is a front view for illustrating the skipping of a leading-edge restriction operation to be performed by an end fence in an embodiment (example 4)

In the meantime, as described above, the placement-mount driver 37 lowers the placement mount 31 by, for example, a height corresponding to a predetermined number of sheets on the basis of a detection result provided by the placement-surface detection sensor (not illustrated). In this regard, the end fence 34 may perform the leading-edge restriction operation as depicted in FIG. 5D while the placement-mount driver 37 is lowering the placement mount 31 so as to shift from a state in which the end fence 34 and the upper surface Ma of a medium M are in contact with each other as depicted in FIG. 5B to a state in which, as depicted in FIG. 5C, the end fence 34 and the upper surface Ma are not in contact with each other.

Figure 6:
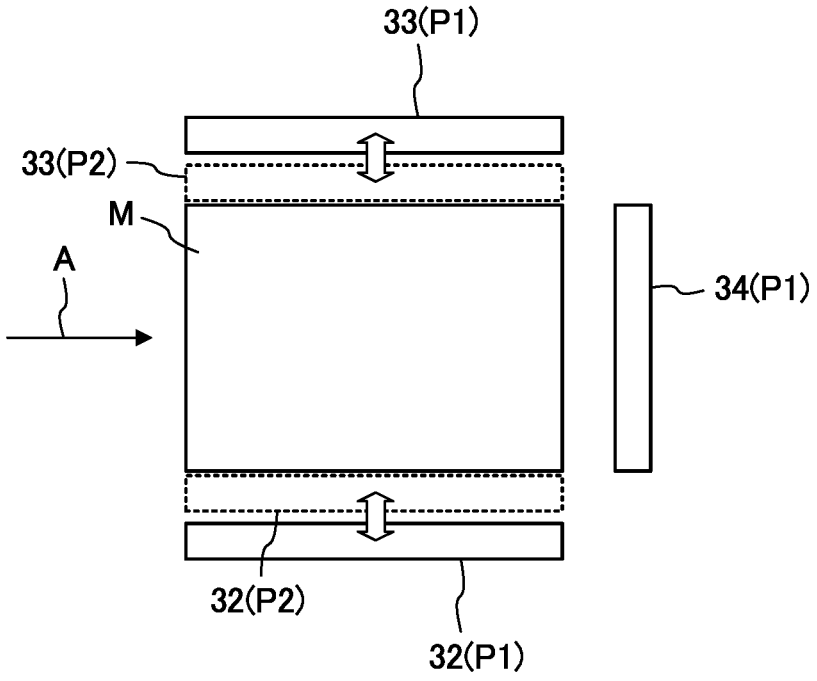
FIG. 6 is a plan view for illustrating a width restriction operation performed by side fences in an embodiment alone.

The side fences 32 and 33 may perform the width restriction operation as depicted in FIG. 6, while the leading-edge restriction operation to be performed by the end fence 34 is skipped as described above when the end fence 34 (abutment member 34*b*) and the upper surface Ma of a medium M are in contact with each other. In the meantime, an arrangement may be made such that irrespective of whether the end fence 34 and the upper surface Ma of a medium M are in contact with each other, only the medium-width position restriction part among the medium-leading-edge position restriction part, an example of which is the end fence 34, and the medium-width position restriction part, examples of which are the side fences 32 and 33, performs the restriction operation (width restriction operation). In this aspect, although the end fence 34 does not perform the leading-edge restriction operation, the end fence 34 and the upper surface Ma of a medium M can be suppressed from coming into contact with each other.

FIGS. 7A-7D are front views for illustrating the leading-edge restriction operation performed by the end fence 34.

Figure 7A:
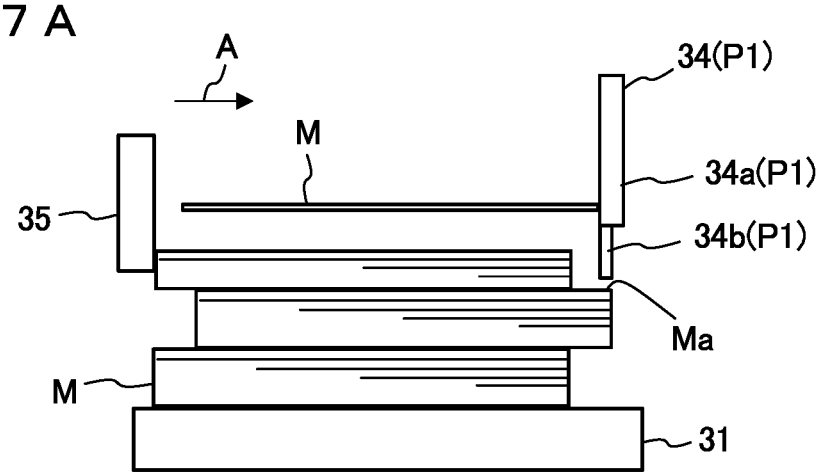
FIG. 7A is a front view for illustrating a leading-edge restriction operation performed by an end fence in an embodiment (example 1)
Figure 7B:
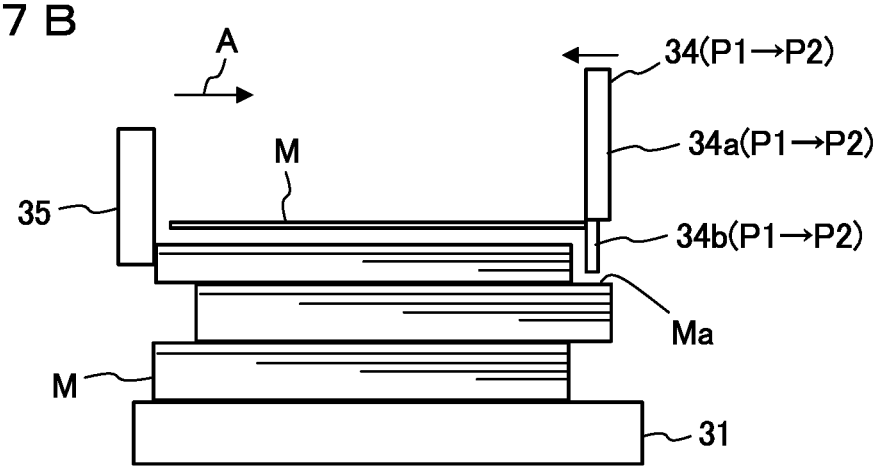
FIG. 7B is a front view for illustrating a leading-edge restriction operation performed by an end fence in an embodiment (example 2)
Figure 7C:
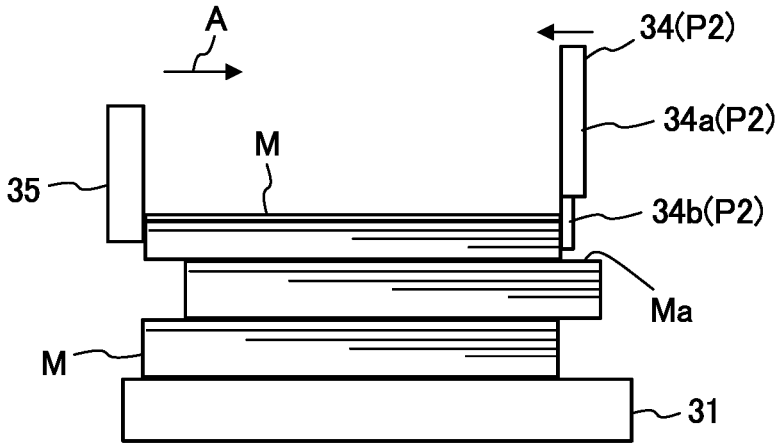
FIG. 7C is a front view for illustrating a leading-edge restriction operation performed by an end fence in an embodiment (example 3)

In a case where, as depicted in FIG. 7A, the end fence 34 (abutment member 34*b*) and the upper surface Ma of a medium M are not in contact with each other even when the number of placed media M after the offset operation is increased and the abutment member 34*b* is maximally lowered under the weight thereof, the end fence 34 starts, as depicted in FIG. 7B, to move toward the restriction position P2 when a predetermined time period has elapsed after a medium M ejected toward the placement mount 31 has come into contact with the end fence 34 at the retracted position P1. Then, the end fence 34 arrives at the restriction position P2, as depicted in FIG. 7C. After the end fence 34 has arrived at the restriction position P2, as described above, the end fence 34 returns to the retracted position P1 depicted in FIG. 7A without stopping at, for example, the restriction position P2.

The control unit 38*a* can determine whether a medium M is in contact with the end fence 34 at the retracted position P1 on the basis of a detection result provided by the medium passage detection sensor 22 of the intermediate transportation apparatus 20 and the ejection velocity (transportation velocity) of the medium M. However, it may be detected whether a medium M is in contact with the end fence 34 by using, for example, a sensor for emitting detection light to the position of the portion of the end fence 34 in contact with the medium M or a sensor disposed on the end fence 34. Meanwhile, the end fence 34 may start to move toward the restriction position P2 before a medium M comes into contact with the end fence 34.

Figure 8:
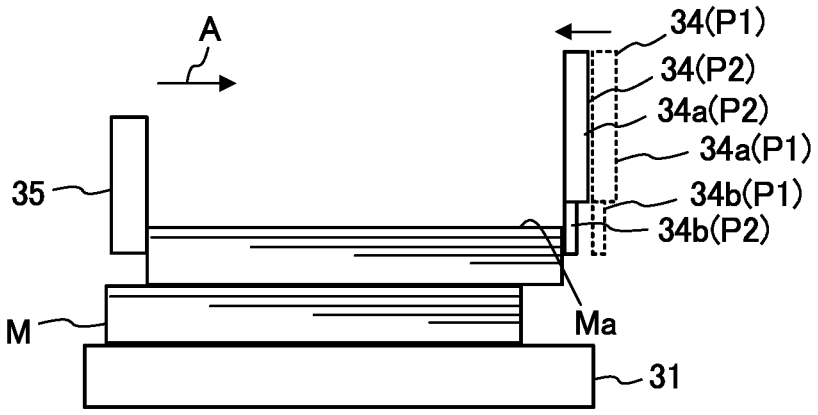
FIG. 8 is a front view for illustrating a leading-edge restriction operation performed by an end fence in an embodiment when the end fence and the upper surface of a medium are not in contact with each other.

In the meantime, when media M are placed on the right side in FIG. 8 (forward side in the ejection direction A) while no media M are placed under the end fence 34, the end fence 34 and the upper surface Ma of a medium M are not in contact with each other at the medium restriction position P2, and thus the control unit 38 does not skip the leading-edge restriction operation to be performed by the end fence 34.

On the basis of ejection medium information of a medium M ejected toward the placement mount 31, the control unit 38*a* may adjust a timing at which the end fence 34 starts to move from the retracted position P1 to the restriction position P2. The movement start timing is not limited to a predetermined period of time after a medium M comes into contact with the end fence 34 at the retracted position P1 but may precede a time at which a medium M comes into contact with the end fence 34 at the retracted position P1. The movement start timing of the side fences 32 and 33 may be the same as that of the end fence 34.

As described above, ejection medium information is the size, orientation, type (e.g., thickness, grammage, material), transportation velocity (i.e., the ejection velocity of the medium ejection apparatus 30), or the like of a medium M. For example, the control unit 38*a* may acquire ejection medium information from the printing apparatus 10 (interface unit 19*c*) on the basis of a print job, a detection result provided by a sensor (not illustrated) disposed on the medium supply part 11, settings of the printing apparatus 10, and the like.

For example, when media M are thin paper and the ejection velocity is relatively low, the control unit 38*a* may advance the movement start timing as it will take a long time before the media M fall. When media M are thick paper and the ejection velocity is relatively high, the control unit 38*a* may advance the movement start timing as the media M tend to exit through a space below the end fence 34. Meanwhile, a user may carry out an experiment for various ejection medium information so as to determine the fall times (degrees of alignment) of media M or the degrees of ease with which media M could exit thorough the space below the end fence 34, thereby creating tables corresponding to the ejection medium information, so that the control unit 38*a* can determine movement start timings by referring to the tables.

The control unit 38*a* may adjust the retracted position P1 of the end fence 34 on the basis of the ejection medium information. The control unit 38*a* may also adjust the retracted positions P1 of the side fences 32 and 33 on the basis of the ejection medium information.

For example, when media M are thick paper or the ejection velocity is relatively high, the control unit 38*a* may set a position relatively far from the restriction position P2 as the retracted position P1 as the media M will be smoothly casted when being ejected toward the placement mount 3. When media M are thin paper or the ejection velocity is relatively low, the control unit 38*a* may set a position relatively close to the restriction position P2 as the retracted position P1 as the media M will not be smoothly casted when being ejected toward the placement mount 3. The user may also carry out an experiment for various ejection medium information so as to determine the degrees of ease with which media M can be casted, the degrees of alignment, or the degrees of ease with which media M could exit thorough the space below the end fence 34, thereby creating tables corresponding to the ejection medium information, so that the control unit 38*a* can adjust the retracted position P1 by referring to the tables.

The end fence 34 does not necessarily need to include the abutment member 34*b*. In this case, lowering the placement mount 31 even only a little will separate the end fence 34 and the upper face Ma of a medium M from each other, thereby shortening a period during which the leading-edge restriction operation to be performed by the end fence 34 is skipped.

In the embodiment described so far, the medium ejection apparatus 30 includes: the placement mount 31 on which media M are placed; the end fence 34, which is an example of the medium-leading-edge position restriction part that moves between the restriction position P2 at which the medium-leading-edge position restriction part restricts the position of the leading edge portion of a medium M ejected toward the placement mount 31 with reference to the ejection direction A of the medium M and the retracted position P1 retracted from the restriction position P2; and the control unit 38*a* that controls the end fence 34 such that the end fence 34 performs a leading-edge restriction operation of moving from the retracted position P1 to the restriction position P2 and moving from the restriction position P2 to the retracted position P1 when the end fence 34 and the upper surface Ma of a medium M are in contact with each other, and controls the end fence 34 such that the end fence 34 does not perform the leading-edge restriction operation when the end fence 34 and the upper surface Ma of a medium M are in contact with each other.

Accordingly, the end fence 34 performs the leading-edge restriction operation when the end fence 34 and the upper surface Ma of a medium M are not in contact with each other and does not perform the leading-edge restriction operation when these two are in contact with each other. Thus, in the present embodiment, while the end fence 34 that limits the position of the leading edge portion of a medium M in the ejection direction A is moving between the restriction position P2 and the retracted position P1, the end fence 34 and the upper surface Ma of the medium M can be suppressed from coming into contact with each other. Hence, displacement of a medium M, which would occur if the end fence 34 and the upper surface Ma of the medium M came to contact with each other, and generation of an image deficiency in an image printed on the upper surface Ma of a medium M, which would occur if the medium M and the end fence 34 scrapped against each other, can be prevented from occurring.

In the present embodiment, the medium ejection apparatus 30 further includes the side fences 32 and 33, which are examples of the medium-width position restriction part that moves between the restriction position P2 at which this restriction part restricts the position of the leading edge portion of a medium M in the width direction orthogonal to the ejection direction A and the retracted position P1 retracted from the restriction position P2. When the end fence 34 and the upper surface Ma of a medium M are in contact with each other, the control unit 38*a* controls the side fences 32 and 33 such that these fences perform the width restriction operation of moving from the retracted positions P1 to the restriction positions P2 and moving from the restriction positions P2 to the retracted positions P1.

The side fences 32 and 33 perform, as described above, the width restriction operation while the end fence 34 does not perform the leading-edge restriction operation, so that media M can be easily aligned at the placement position.

In the present embodiment, the medium ejection apparatus 30 further includes the placement-mount driver 37 that lifts or lowers the placement mount 31. The control unit 38*a* controls the end fence 34 such that this fence performs the leading-edge restriction operation, while the placement-mount driver 37 is lowering the placement mount 31 so as to shift from a state in which the end fence 34 and the upper surface Ma of a medium M are in contact with each other to a state in which the end fence 34 and the upper surface Ma are not in contact with each other.

Accordingly, at a timing at which the end fence 34 is separated from the upper surface Ma of a medium M, the leading-edge restriction operation can be performed for more media M. Thus, media M can be easily aligned at the placement position.

In the present embodiment, on the basis of ejection medium information of a medium M ejected toward the placement mount 31, such as the size, the orientation, the type (e.g., thickness, grammage, material), or the transportation velocity, the control unit 38*a* adjusts at least either the retracted position P1 of the end fence 34, i.e., an example of the medium-leading-edge position restriction part, or the timing at which the end fence 34 starts to move from the retracted position P1 to the restriction position P2.

Accordingly, the control unit 38*a* can adjust the retracted position P1 of the end fence 34 in accordance with the degree of ease with which media M can be casted when being ejected toward the placement mount 31, the degree of alignment of media M, or the degree of ease with which media M could exit through the space below the end fence 34. In addition, the control unit 38*a* can start the movement of the end fence 34 from the retracted position P1 to the restriction position P2 at a timing tailored to a time required before a medium M falls or the degree of ease with which the medium M could exit through the space below the end fence 34. Thus, media M can be easily aligned at the placement position and suppressed from exiting through the space below the end fence 34.

The present embodiment also includes the end fence 34 and the offset guide 35, i.e., examples of offset means for performing the offset operation for offsetting the placement position of media M on the placement mount 31 forward or rearward in the ejection direction A. The control unit 38*a* controls the end fence 34 such that the leading-edge restriction operation is not performed in a case where the end fence 34 and the upper surface Ma of a medium M are in contact with each other when a predetermined number of media M have been ejected for the first time after the end fence 34 and the offset guide 35 performed the offset operation rearward in the ejection direction A.

Accordingly, the control unit 38*a* can suppress the end fence 34 from coming into contact with the upper surfaces Ma of a predetermined number of media M ejected for the first time after the offset operation is performed rearward in the ejection direction A.

Another Embodiment

The following describes the restriction operation performed by the end fence 34 in another embodiment while omitting descriptions thereof that have already been given herein.

Figure 9:
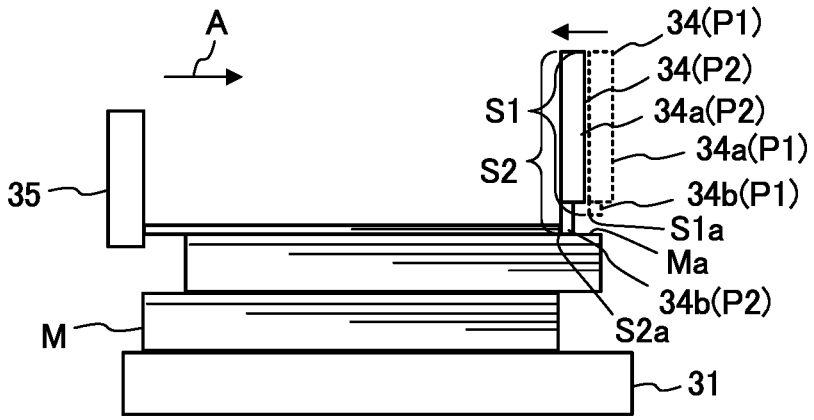
FIG. 9 is a front view illustrating an end fence and an offset guide in another embodiment.

FIG. 9 is a front view illustrating the end fence 34 and the offset guide 35.

FIGS. 10A-10D are front views for illustrating the restriction operation performed by the end fence 34.

In the present embodiment, when a predetermined number of media M have been ejected for the first time after the offset operation was performed rearward in the ejection direction A, i.e., when the end fence 34 (abutment member 34*b*) is in contact with the upper surface Ma of a medium M, the control unit 38*a* depicted in FIG. 2 controls the end fence 34 by means of the restriction driver 36 such that, as depicted in FIG. 9, the abutment member 34*b* of the end fence 34 is lifted from the restriction position P2 to the retracted position P1 and stops being lifted so as to be held at a lifted position.

The end fence 34 starts to move, as depicted in FIG. 10B, toward the restriction position P2 when a predetermined period of time has elapsed after a medium M ejected toward the placement mount 31 has, as depicted in FIG. 10A, come into contact with the end fence 34 at the retracted position P1. The control unit 38*a* can determine whether a medium M is in contact with the end fence 34 at the retracted position P1 on the basis of a detection result provided by the medium passage detection sensor 22 of the intermediate transportation apparatus 20 and the ejection velocity (transportation velocity) of media M. However, it may be detected whether a medium M has been in contact with the end fence 34 by using, for example, a sensor for emitting detection light to the position of the portion of the end fence 34 in contact with the medium M or a sensor disposed on the end fence 34. Meanwhile, the end fence 34 may start to move toward the restriction position P2 before a medium M comes into contact with the end fence 34.

After the end fence 34 has moved by a distance determined in advance, the control unit 38*a* stops the holding of the abutment member 34*b* at the lifted position by means of the restriction driver 36. As a result, the abutment member 34*b* is lowered under the weight thereof, and as depicted in FIG. 10C, the abutment member 34*b* comes into contact with the upper surface Ma of a medium M at the restriction position P2. Accordingly, the abutment member 34*b* (end fence 34) is not in contact with the upper surface of a medium M when being located at a position other than the restriction position P2.

The control unit 38*a*, as described above, moves up or down the abutment member 34*b* of the end fence 34 such that, as depicted in FIGS. 10A-10C, when being located at the retracted position P1 depicted in FIG. 10A, the lower edge portion S1*a*, S2*a* of the abutment surface S1, S2 (lower edge portion S1*a* of abutment surface S1) is positioned higher than when being located at the restriction position P2 (lower edge portion S2*a* of abutment surface S2) depicted in FIG. 10C.

While the end fence 34 is moving from the retracted position P1 to the restriction position P2, the control unit 38*a* may control, by means of the restriction driver 36, the abutment member 34*b* so as to be lowered under the weight thereof such that the lower edge portion S1*a*, S2*a* of the abutment surface S1, S2 is lowered from the retracted position P1 (lower edge portion S1*a* of abutment surface S1), i.e., perform control for stopping the holding of the abutment member 34*b* at the lifted position. However, after the end fence 34 has arrived at the restriction position P2, the control unit 38*a* may stop the holding of the abutment member 34*b* at the lifted position such that the abutment member 34*b* is lowered under the weight thereof.

Figure 12:
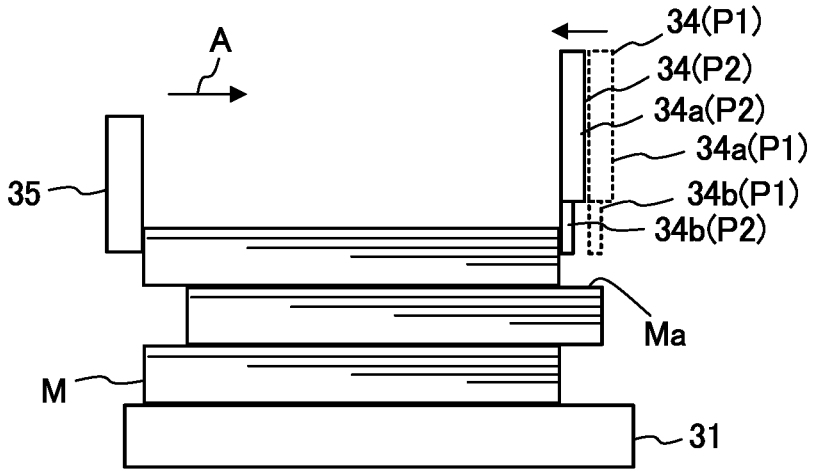
FIG. 12 is a front view for illustrating a restriction operation performed by an end fence in another embodiment when the end fence and the upper surface of a medium are not in contact with each other (example 1)

The control unit 38*a* does not need to perform the control for lifting the abutment member 34*b* in a case where, as depicted in FIG. 12, the end fence 34 (abutment member 34*b*) and the upper surface Ma of a medium M are not in contact with each other at the medium restriction position P2 even when the number of placed media M is increased after the offset operation and the abutment member 34*b* is maximally lowered to under the weight thereof.

Figure 13:
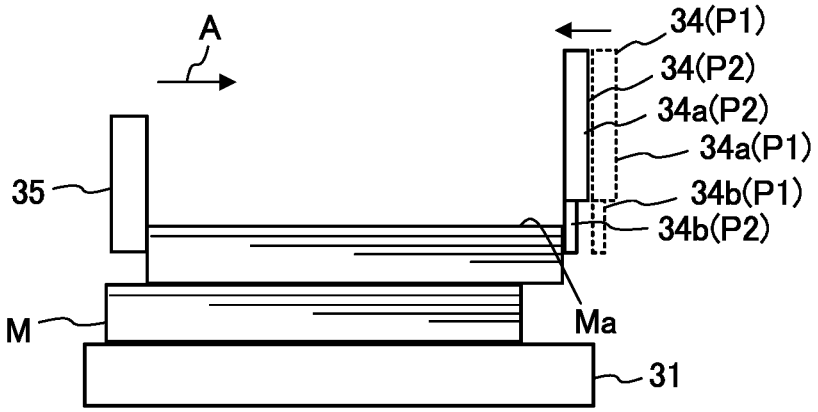
FIG. 13 is a front view for illustrating a restriction operation performed by an end fence in another embodiment when the end fence and the upper surface of a medium are not in contact with each other (example 2)

Even when, as depicted in FIG. 13, media M are placed at a front position in the ejection direction A (right side in FIG. 13) as a result of the end fence 34 and the offset guide 35 performing the offset operation as described above (when no media M are placed under the end fence 34), the end fence 34 and the upper surface Ma of a medium M are not in contact with each other at the medium restriction position P2. Hence, the control unit 38*a* does not need to perform the control for lifting the abutment member 34*b*. Thus, the control unit 38*a* may perform the control for lifting the abutment member 34*b* at the retracted position P1 only when media M are placed under the end fence 34 at the restriction position P2.

As described above, on the basis of ejection medium information of a medium M ejected toward the placement mount 31, the control unit 38*a* may adjust at least either the retracted position P1 of the end fence 34 or the timing at which the end fence 34 starts to move from the retracted position P1 to the restriction position P2.

In the present embodiment, the end fence 34 also does not necessarily need to include the abutment member 34*b*. In this case, the fence body 34*a* may move up or down between the retracted position P1 and the restriction position P2 such that the lower edge portion S1*a* of the abutment surface S1 at the retracted position P1 is positioned higher than the lower edge portion S2*a* of the abutment surface S2 at the restriction position P2.

Figure 11:
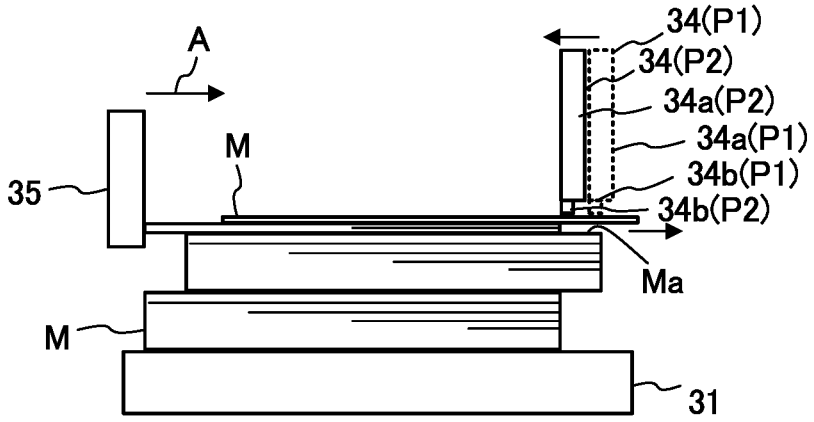
FIG. 11 is a front view for illustrating a restriction operation performed by an end fence in a comparative example.

In the meantime, a medium M could exit through the space below the end fence 34 (abutment member 34*b*) when, as in the comparative example depicted in FIG. 11, the abutment member 34*b* is held at the lifted position while being located at the restriction position P2, as in the case in which the abutment member 34*b* is held at the lifted position while being located at the retracted position P1. Thus, an arrangement may be made such that the abutment member 34*b* starts to be lowered before the end fence 34 arrives at the restriction position P2. However, the abutment member 34*b* and the upper surface Ma of a medium M will scrap against each other if the abutment member 34*b* contacts the upper surface Ma of the medium M while the end fence 34 is moving from the retracted position P1 to the restriction position P2, and thus the abutment member 34*b* will desirably come into contact with the upper surface Ma of the medium M at, or after, the timing at which the end fence 34 arrives at the restriction position P2.

In the embodiment described so far, the medium ejection apparatus 30 includes: the placement mount 31 on which media M are placed; the end fence 34, which is an example of the medium-leading-edge position restriction part that moves between the restriction position P2 at which the medium-leading-edge position restriction part restricts a medium M ejected toward the placement mount 31 and the retracted position P1 retracted from the restriction position P2; and the control unit 38*a* that controls the end fence 34 such that when being located at the retracted position P1, the lower edge portion S1*a*, S2*a* of the abutment surface S1, S2 abutted by media M (lower edge portion S1*a* of abutment surface S1) is positioned higher than when being located at the restriction position P2 (lower edge portion S2*a* of abutment surface S2). The control unit 38*a* controls the end fence 34 such that the end fence 34 is not in contact with the upper surface Ma of a medium M placed on the placement mount 31 when being located at a position other than the restriction position P2.

Accordingly, although the end fence 34 may be in contact with the upper surface Ma of a medium M when being located at the restriction position P2, the end fence 34 will not be in contact with the upper surface Ma of a medium M when being located at a position other than the restriction position P2. Thus, in the present embodiment, while the end fence 34 that restricts media M is moving between the restriction position P2 and the retracted position P1, the end fence 34 and the upper surface Ma of the medium M can be suppressed from coming into contact with each other. Hence, displacement of a medium M, which would occur if the end fence 34 and the upper surface Ma of the medium M came into contact with each other, and generation of an image deficiency in an image printed on the upper surface Ma of the medium M, which would occur if the medium M and the end fence 34 scrapped against each other, can be prevented from occurring.

In the present embodiment, the end fence 34, i.e., an example of the medium-leading-edge position restriction part, includes the abutment member 34*b* that is abutted by media M and capable of moving up or down, and when being located at the retracted position P1, the lower edge portion S1*a*, S2*a* of the abutment surface S1, S2 (lower edge portion S1*a* of abutment surface S1) is positioned higher than when being located at the restriction position P2 (lower edge portion S2*a* of abutment surface S2), in accordance with the abutment member 34*b* being lifted.

The abutment member 34*b* moves up or down as described above so that the end fence 34 and the upper surface Ma of a medium M can be suppressed from coming into contact with each other with a simple configuration in comparison with aspects in which the entirety of the end fence 34 moves up or down.

In the present embodiment, while the end fence 34, i.e., an example of the medium-leading-edge position restriction part, is moving from the retracted position P1 to the restriction position P2, the control unit 38*a* controls the end fence 34 such that the lower edge portion S1*a*, S2*a* of the abutment surface S1, S2 is lowered from the retracted position P1 (lower edge portion S1*a* of abutment surface S1).

Accordingly, media M can be suppressed from exiting through the space below the end fence 34 (abutment member 34*b*), unlike in the comparative example depicted in FIG. 11. In addition, the end fence 34 can be suppressed from being placed on the upper surface Ma of a medium M or scrapping against sides of media M in comparison with aspects in which after the end fence 34 reaches the restriction position P2, the lower edge portion S1*a*, S2*a* of the abutment surface S1, S2 is lowered by a larger amount.

In the present embodiment, when the end fence 34, i.e., an example of the medium-leading-edge position restriction part, and the upper surface Ma of a medium M are, as depicted in FIG. 10C, in contact with each other at the restriction position P2, the control unit 38*a* controls the end fence 34 such that the lower edge portion S1*a*, S2*a* of the abutment surface S1, S2 is positioned at a higher position when being located at the retracted position P1 (abutment surface S1) than when being located at the restriction position P2 (abutment surface S2); and when the end fence 34 and the upper surface Ma of a medium M are, as depicted in FIGS. 12 and 13, not in contact with each other at the restriction position P2, the control unit 38*a* controls the end fence 34 such that the lower edge portion S1*a*, S2*a* of the abutment surface S1, S2 is positioned at an equal height when being located at the retracted position P1 (lower edge portion S1*a* of abutment surface S1) and when being located at the restriction position P2 (lower edge portion S2*a* of abutment surface S2).

Accordingly, in a case where the end fence 34 is not in contact with the upper surface Ma of a medium M when being located at the restriction position P2, the process for controlling the end fence 34 such that the lower edge portion S1*a*, S2*a* of the abutment surface S1, S2 is positioned higher when being located at the retracted position P1 (lower edge portion S1*a* of abutment surface S1) than when being located at the restriction position P2 (lower edge portion S2*a* of abutment surface S2) can be skipped. In addition, the skipping of the controlling of the end fence 34 like this allows media M to be suppressed from exiting through the space below the end fence 34 (abutment member 34*b*), unlike in the comparative example depicted in FIG. 11.

In the present embodiment, on the basis of ejection medium information of a medium M ejected toward the placement mount 31, such as the size, the orientation, the type (e.g., thickness, grammage, material), or the ejection velocity, the control unit 38*a* adjusts at least either the retracted position P1 of the end fence 34, i.e., an example of the medium-leading-edge position restriction part, or the timing at which the end fence 34 starts to move from the retracted position P1 to the restriction position P2.

Accordingly, the control unit 38*a* can start the movement of the end fence 34 from the retracted position P1 to the restriction position P2 at a timing tailored to a time required before a medium M falls or the degree of ease with which the medium M could exit through the space below the end fence 34. In addition, the control unit 38*a* can adjust the retracted position P1 of the end fence 34 in accordance with the degree of ease with which media M can be casted when being ejected toward the placement mount 31, the degree of alignment of media M, or the degree of ease with which media M could exit through the space below the end fence 34. Thus, media M can be easily aligned at the placement position and suppressed from exiting through the space below the end fence 34.

The present embodiment also includes the end fence 34 and the offset guide 35, i.e., examples of the offset means for performing the offset operation for offsetting the placement position of media M on the placement mount 31 forward or rearward in the ejection direction A. The control unit 38*a* controls the end fence 34 such that the end fence 34 is not in contact with the upper surface Ma of a medium M placed on the placement mount 31 while being located at a position other than the restriction position P2 when a predetermined number of media M have been ejected for the first time after the end fence 34 and the offset guide 35 performed the offset operation rearward in the ejection direction A.

Accordingly, the control unit 38*a* can suppress the end fence 34 from coming into contact with the upper surfaces Ma of a predetermined number of media M ejected for the first time after the offset operation is performed rearward in the ejection direction A.

The present invention is not simply limited to the embodiments described herein. Components of the embodiments may be embodied in a varied manner in an implementation phase without departing from the gist of the invention. A plurality of components disclosed with reference to the described embodiments may be combined, as appropriate, to achieve various inventions. For example, all of the components indicated with reference to embodiments may be combined as appropriate. Accordingly, various variations and applications can be provided, as a matter of course, without departing from the gist of the invention. The following indicates appendixes.

A first medium ejection apparatus comprising:

a placement mount on which media are placed;

a leading-edge restriction part that moves between a restriction position at which the leading-edge restriction part restricts a position of a leading edge portion of a medium ejected toward the placement mount with reference to an ejection direction of the medium and a retracted position retracted from the restriction position; and a control unit that controls the leading-edge restriction part such that the leading-edge restriction part performs a leading-edge restriction operation of moving from the retracted position to the restriction position and moving from the restriction position to the retracted position when the leading-edge restriction part and an upper surface of a medium are not in contact with each other, and controls the leading-edge restriction part such that the leading-edge restriction part does not perform the leading-edge restriction operation when the leading-edge restriction part and an upper surface of a medium are in contact with each other.

The first medium ejection apparatus further comprising:

a width restriction part that moves between a restriction position at which the width restriction part restricts a position of a leading edge portion of a medium with reference to a width direction of the medium orthogonal to the ejection direction of the medium and a retracted position retracted from the restriction position, wherein the control unit controls the width restriction part such that the width restriction part performs a width restriction operation of moving from the retracted position to the restriction position and moving from the restriction position to the retracted position when the leading-edge restriction part and an upper surface of a medium are in contact with each other.

The first medium ejection apparatus further comprising:

a placement-mount driver that lifts or lowers the placement mount, wherein the control unit controls the leading-edge restriction part such that the leading-edge restriction part performs the leading-edge restriction operation while the placement-mount driver is lowering the placement mount so as to shift from a state in which the leading-edge restriction part and an upper surface of a medium are in contact with each other to a state in which the leading-edge restriction part and the upper surface of the medium are not in contact with each other.

The first medium ejection apparatus, wherein on the basis of ejection medium information of a medium ejected toward the placement mount, the control unit adjusts at least either the retracted position of the leading-edge restriction part or a timing at which the leading-edge restriction part starts to move from the retracted position to the restriction position.

The first medium ejection apparatus further comprising:

an offset means for performing an offset operation for offsetting a placement position of media on the placement mount forward or rearward in the ejection direction, wherein in a case where a predetermined number of media have been ejected for the first time after the offset means performed the offset operation rearward in the ejection direction, the control unit controls the leading-edge restriction part such that the leading-edge restriction part does not perform the leading-edge restriction operation when the leading-edge restriction part and an upper surface of a medium are in contact with each other.

A second medium ejection apparatus comprising:

a placement mount on which media are placed;

a restriction part that moves between a restriction position at which the restriction part restricts media ejected toward the placement mount and a retracted position retracted from the restriction position; and a control unit that controls the restriction part such that a lower edge portion of an abutment surface thereof abutted by media is positioned higher when being located at the retracted position than when being located at the restriction position, wherein the control unit controls the restriction part such that the restriction part is not in contact with an upper surface of a medium placed on the placement mount while being located at a position other than the restriction position.

The second medium ejection apparatus, wherein the control unit controls the restriction part such that the lower edge portion of the abutment surface is lowered from the retracted position while the restriction part is moving from the retracted position to the restriction position.

The second medium ejection apparatus, wherein when the restriction part and an upper surface of a medium placed on the placement mount are in contact with each other at the restriction position, the control unit controls the restriction part such that the lower edge portion of the abutment surface is positioned higher when being located at the retracted position than when being located at the restriction position, and when the restriction part and the upper surface of the medium placed on the placement mount are not in contact with each other at the restriction position, the control unit controls the restriction part such that the lower edge portion of the abutment surface is positioned at an equal height when being located at the retracted position and when being located at the restriction position.

The second medium ejection apparatus, wherein on the basis of ejection medium information of a medium ejected toward the placement mount, the control unit adjusts at least either the retracted position of the restriction part or a timing at which the restriction part starts to move from the retracted position to the restriction position.

The second medium ejection apparatus, further comprising:

an offset means for performing an offset operation for offsetting a placement position of media on the placement mount forward or rearward in an ejection direction in which media are ejected toward the placement mount, wherein in a case where a predetermined number of media have been ejected for the first time after the offset means performed the offset operation rearward in the ejection direction, the control unit controls the restriction part such that the restriction part is not in contact with an upper surface of a medium placed on the placement mount while being located at a position other than the restriction position.

What is claimed is:

1. A medium ejection apparatus comprising:

a placement mount on which media are placed;

a medium-leading-edge position restriction part that moves between a restriction position at which the medium-leading-edge restriction part restricts a position of a leading edge portion of a medium ejected toward the placement mount with reference to an ejection direction of the medium and a retracted position retracted from the restriction position; and a medium position control unit that controls the medium-leading-edge position restriction part such that the medium-leading-edge position restriction part performs a leading-edge restriction operation of moving from the retracted position to the restriction position and moving from the restriction position to the retracted position when the medium-leading-edge position restriction part and an upper surface of the media positioned under the medium-leading-edge position restriction part and not restricted by the medium-leading-edge position restriction part are not in contact with each other, and controls the medium-leading-edge position restriction part such that the medium-leading-edge position restriction part does not perform the leading-edge restriction operation when the medium-leading-edge position restriction part and the upper surface are in contact with each other.

2. The medium ejection apparatus of claim 1, further comprising:

a medium-width position restriction part that moves between a restriction position at which the medium-width position restriction part restricts a position of a leading edge portion of a medium with reference to a width direction of the medium orthogonal to the ejection direction and a retracted position retracted from the restriction position.

3. The medium ejection apparatus of claim 1, further comprising:

a placement-mount driver that lifts or lowers the placement mount, wherein the medium position control unit controls the medium-leading-edge position restriction part such that the medium-leading-edge position restriction part performs the leading-edge restriction operation while the placement-mount driver is lowering the placement mount so as to shift from a state in which the medium-leading-edge position restriction part and the upper surface are in contact with each other to a state in which the medium-leading-edge position restriction part and the upper surface are not in contact with each other.

4. The medium ejection apparatus of claim 1, wherein on the basis of ejection medium information of a medium ejected toward the placement mount, the medium position control unit adjusts at least either the retracted position of the medium-leading-edge position restriction part or a timing at which the medium-leading-edge position restriction part starts to move from the retracted position to the restriction position.

5. The medium ejection apparatus of claim 1, further comprising:

an offset guide that performs, together with the medium-leading-edge position restriction part, an offset operation for offsetting a placement position of media on the placement mount forward or rearward in the ejection direction, wherein in a case where a predetermined number of media have been ejected for the first time after the offset guide and the medium-leading-edge position restriction part performed the offset operation rearward in the ejection direction, the medium position control unit controls the medium-leading-edge position restriction part such that the medium-leading-edge position restriction part does not perform the leading-edge restriction operation when the medium-leading-edge position restriction part and the upper surface are in contact with each other.

6. The medium ejection apparatus of claim 1, wherein the medium position control unit controls the medium-leading-edge position restriction part such that a lower edge portion of an abutment surface thereof abutted by media is positioned higher when being located at the retracted position than when being located at the restriction position, and the medium position control unit controls the medium-leading-edge position restriction part such that the medium-leading-edge position restriction part is not in contact with the upper surface while being located at a position other than the restriction position.

7. The medium ejection apparatus of claim 6, wherein the medium position control unit controls the medium-leading-edge position restriction part such that the lower edge portion of the abutment surface is lowered from the retracted position while the medium-leading-edge position restriction part is moving from the retracted position to the restriction position.

8. The medium ejection apparatus of claim 6, wherein when the medium-leading-edge position restriction part and the upper surface are in contact with each other at the restriction position, the medium position control unit controls the medium-leading-edge position restriction part such that the lower edge portion of the abutment surface is positioned higher when being located at the retracted position than when being located at the restriction position, and when the medium-leading-edge position restriction part and the upper surface are not in contact with each other at the restriction position, the medium position control unit controls the medium-leading-edge position restriction part such that the lower edge portion of the abutment surface is positioned at an equal height when being located at the retracted position and when being located at the restriction position.

9. The medium ejection apparatus of claim 6, wherein on the basis of ejection medium information of a medium ejected toward the placement mount, the medium position control unit adjusts at least either the retracted position of the medium-leading-edge position restriction part or a timing at which the restriction part starts to move from the retracted position to the restriction position.

10. The medium ejection apparatus of claim 6, further comprising:

an offset guide that performs, together with the medium-leading-edge position restriction part, an offset operation for offsetting a placement position of media on the placement mount forward or rearward in an ejection direction in which media are ejected toward the placement mount, wherein in a case where a predetermined number of media have been ejected for the first time after the medium-leading-edge position restriction part and the offset guide performed the offset operation rearward in the ejection direction, the medium position control unit controls the medium-leading-edge position restriction part such that the medium-leading-edge position restriction part is not in contact with the upper surface while being located at a position other than the restriction position.

11. The medium ejection apparatus of claim 2, wherein the medium position control unit controls the medium-width position restriction part such that the medium-width position restriction part performs a width restriction operation of moving from the retracted position to the restriction position and moving from the restriction position to the retracted position when the medium-leading-edge position restriction part and the upper surface are in contact with each other.

12. A medium ejection apparatus comprising:

a placement mount on which media are placed;

a medium-leading-edge position restriction part that moves between a restriction position at which the medium-leading-edge restriction part restricts a position of a leading edge portion of a medium ejected toward the placement mount with reference to an ejection direction of the medium and a retracted position retracted from the restriction position;

a medium position control unit that controls the medium-leading-edge position restriction part such that the medium-leading-edge position restriction part performs a leading-edge restriction operation of moving from the retracted position to the restriction position and moving from the restriction position to the retracted position when the medium-leading-edge position restriction part and an upper surface of a medium are not in contact with each other, and controls the medium-leading-edge position restriction part such that the medium-leading-edge position restriction part does not perform the leading-edge restriction operation when the medium-leading-edge position restriction part and an upper surface of a medium are in contact with each other; and a medium-width position restriction part that moves between a restriction position at which the medium-width position restriction part restricts a position of a leading edge portion of a medium with reference to a width direction of the medium orthogonal to the ejection direction and a retracted position retracted from the restriction position, wherein the medium position control unit controls the medium-width position restriction part such that the medium-width position restriction part performs a width restriction operation of moving from the retracted position to the restriction position and moving from the restriction position to the retracted position when the medium-leading-edge position restriction part and an upper surface of a medium are in contact with each other.

13. A medium ejection apparatus comprising:

a placement mount on which media are placed;

a medium-leading-edge position restriction part that moves between a restriction position at which the medium-leading-edge restriction part restricts a position of a leading edge portion of a medium ejected toward the placement mount with reference to an ejection direction of the medium and a retracted position retracted from the restriction position; and a medium position control unit that controls the medium-leading-edge position restriction part such that the medium-leading-edge position restriction part performs a leading-edge restriction operation of moving from the retracted position to the restriction position and moving from the restriction position to the retracted position when the medium-leading-edge position restriction part and an upper surface of a medium are not in contact with each other, and controls the medium-leading-edge position restriction part such that the medium-leading-edge position restriction part does not perform the leading-edge restriction operation when the medium-leading-edge position restriction part and an upper surface of a medium are in contact with each other, wherein the medium position control unit controls the medium-leading-edge position restriction part such that a lower edge portion of an abutment surface thereof abutted by media is positioned higher when being located at the retracted position than when being located at the restriction position, the medium position control unit controls the medium-leading-edge position restriction part such that the medium-leading-edge position restriction part is not in contact with an upper surface of a medium placed on the placement mount while being located at a position other than the restriction position, and when the medium-leading-edge position restriction part and an upper surface of a medium placed on the placement mount are in contact with each other at the restriction position, the medium position control unit controls the medium-leading-edge position restriction part such that the lower edge portion of the abutment surface is positioned higher when being located at the retracted position than when being located at the restriction position, and when the medium-leading-edge position restriction part and the upper surface of the medium are not in contact with each other at the restriction position, the medium position control unit controls the medium-leading-edge position restriction part such that the lower edge portion of the abutment surface is positioned at an equal height when being located at the retracted position and when being located at the restriction position.

* * * * *